United States Patent [19]

O et al.

[11] Patent Number: 4,770,312

[45] Date of Patent: Sep. 13, 1988

[54] DETACHABLE CASE

[76] Inventors: Judy O, 5F, No. 114-8,, Yu Che Kow, Yu Che Li, Tan Shui Jenn, Taipei Hsien; Carol Jan, No. 22, Alley 50, Lane 29, Yang Ming St., Chung Cherng Li, Pan Chyau, Taipei Hsien, both of Taiwan

[21] Appl. No.: 61,824

[22] Filed: Jun. 10, 1987

[51] Int. Cl.[4] ..... B65D 6/28

[52] U.S. Cl. ..... 220/4 B; 190/107; 220/4 R; 220/4 F

[58] Field of Search ..... 190/1, 107, 103, 105, 190/122, 124, 21; 220/4 B, 4 C, 4 D, 4 E, 4 F, 4 R, 6, 7

[56] References Cited

U.S. PATENT DOCUMENTS

| | | | |
|---|---|---|---|
| 3,236,404 | 2/1966 | Boscamp | 220/4 R |
| 3,962,010 | 6/1976 | Riou et al. | 190/122 |
| 4,050,604 | 9/1977 | Flanders | 220/4 F |
| 4,471,898 | 9/1984 | Parker | 220/4 R |

FOREIGN PATENT DOCUMENTS

| | | | |
|---|---|---|---|
| 2426224 | 12/1975 | Fed. Rep. of Germany | 190/122 |
| 2827798 | 1/1979 | Fed. Rep. of Germany | 220/4 F |
| 1544543 | 10/1968 | France | 190/122 |

*Primary Examiner*—Jimmy G. Foster

*Attorney, Agent, or Firm*—Browdy and Neimark

[57] ABSTRACT

Two main rectangularly-shaped panels, each of said panels having projections on all four of its edges; four upper and four lower pieces having two thin walls which are separated by a partition to form an inside cavity, each of the pieces having distal ends forming 90 degree angles with each other; a cavity is formed in each of the pieces; four upper and four lower corner-pieces, all of the corner pieces having projections at either distal lateral end thereof, said projections being at an angle of 90 degrees from each other and tightly fitting into the appropriate cavities so as to form a detachable case.

1 Claim, 6 Drawing Sheets

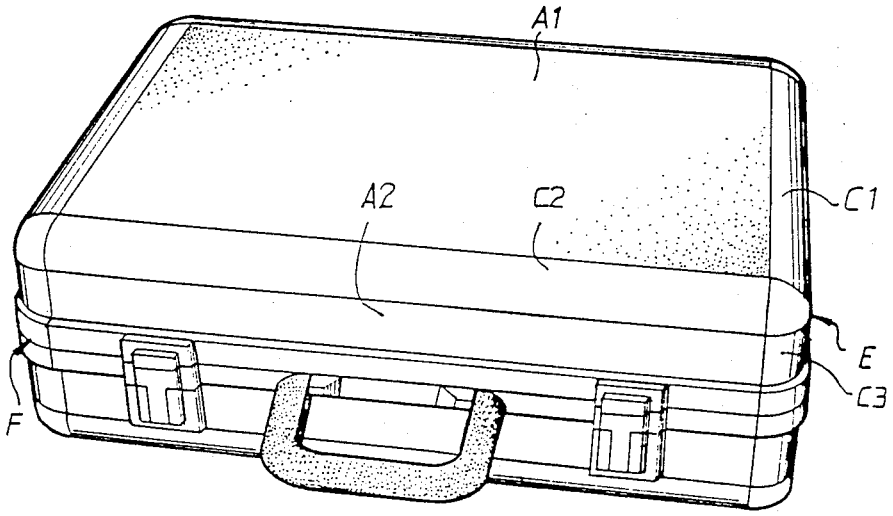
PRIOR ART
FIG. 4-A

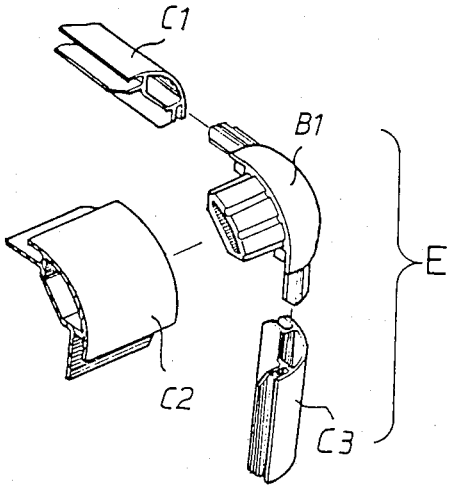
PRIOR ART
FIG. 4-B

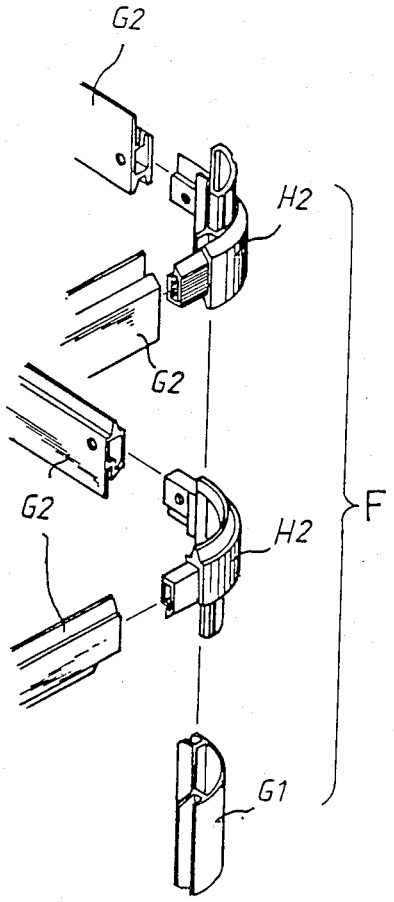
PRIOR ART
FIG. 4-C

DETACHABLE CASE

BACKGROUND OF THE INVENTION

This invention relates to a detachable case made up of relatively few pieces, and which is easy to assemble and disassemble. In the past detachable suitcases and briefcases were made of too many pieces to be manufactured cheaply. Because of the number of pieces, it was complicated and time-consuming to assemble, in addition to being expensive to produce.

FIGS. 4-A through 4-C show various views of a conventional detachable suitcase. These views show that conventional detachable suitcases have a corner section E, including parts B1, C1, C2 and C3; a middle section F, including parts G1, G2, and H2; a main panel A1 and additional side pieces A2. Obviously, the number of pieces involved complicates assembly and disassembly thereof.

It is the purpose of this present invention, therefore, to mitigate and/or obviate the above-mentioned drawbacks in the manner set forth in the detailed description of the preferred embodiment.

SUMMARY OF THE INVENTION

A primary objective of this invention is to provide a detachable carry-all case which has a minimum number of pieces and which is detachable so as to save space when not in use.

Another objective of this invention is to provide a detachable carry-all case which allows for quick assemblage.

A further objective of this invention is to provide a structurally sound and at the same time light carry-all case.

Further objectives and advantages of the present invention will become apparent as the following description proceeds, and the features of novelty which characterize the invention are pointed out with particularity in the claims annexed to and forming a part of this invention.

BRIEF DESCRIPTION OF THE DRAWINGS

FIGS. 4A, 4B, and 4C are all various views of the prior art.

DETAILED DESCRIPTION OF THE PREFERRED EMBODIMENT

Figure 1:
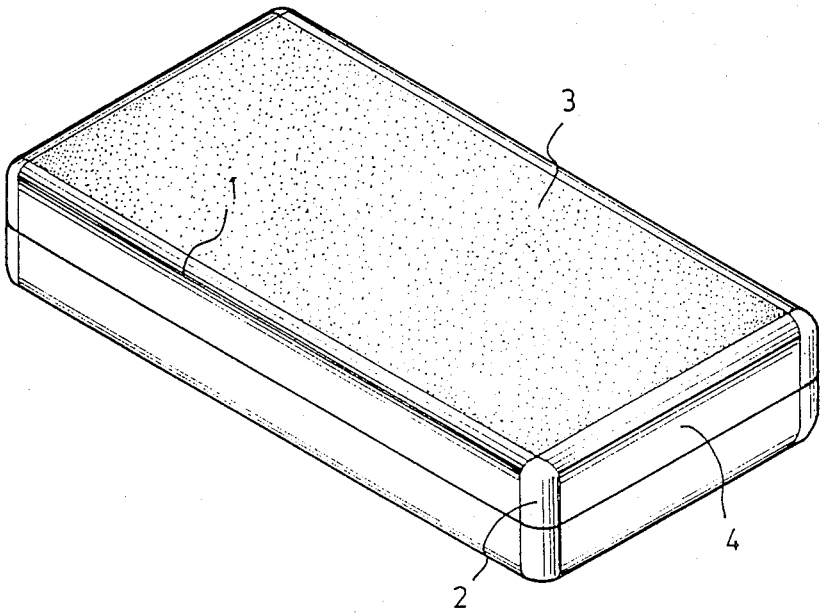
FIG. 1 is a perspective view of a carry-all case in accordance with the present invention.

Referring to FIG. 1, it can be seen that the present invention comprises two main panels 3, side pieces 1, corner pieces 2 and end pieces 4. Although only one of each is shown in FIG. 1, it will be understood that due to the symmetry of the invention that there are more than one of each type of piece.

The main panels 3 are flat and rectangular in shape, with a protrusion 31 on each of its four edges for engaging with either an end or a side piece, as will be discussed further below.

Figure 2:
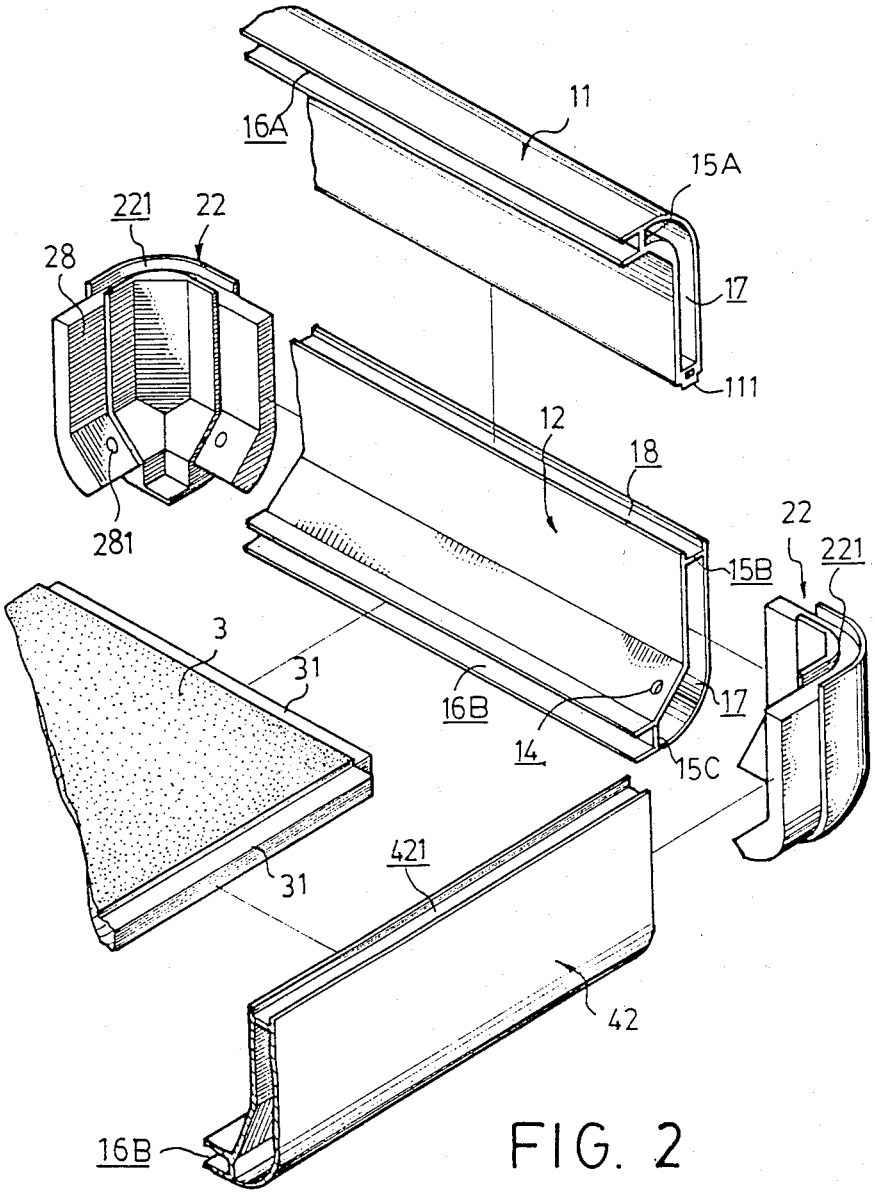
FIG. 2 is a partially cutaway exploded view showing some of the various pieces of a carry-all case in accordance with the present invention and how they fit together.

Referring to FIG. 2, the upper and lower side pieces 11 and 12, respectively, and the lower end pieces 42 are substantially similar to each other. Although the upper end pieces 41 are not shown in FIG. 2, it will be understood that its shape is substantially similar to the upper side piece 11, except that it is shorter in length than the upper side piece 11. The cross-sections of the upper end piece 41 and the upper side piece 11 are identical.

Looking at the upper side piece 11 for reference purposes, the basic structure of the upper side pieces 11 and the upper end pieces 41 (see FIG. 3) will be explained. These upper pieces, 11 and 41, comprise two thin walls which partially enclose a cavity 17, with a channel 16A and a protrusion 111 also enclosing the cavity 17. The two walls are curved so that the two ends of the walls are substantially perpendicular to each other. An upper partition 15A both separates the two walls and forms the inner surface of the channel 16 near the upper distal end of the two walls. In addition, the upper partition 15A provides the upper side piece 11 with a high degree of structural stability without forfeiting lightness of weight in the upper side piece 11. The lower distal end of the upper side piece 11 has a protrusion 111 thereon which connects the lower portion of the two walls. Note that the distal lateral ends of all the side pieces and end pieces are open so as to be engageable with (i.e. receive) the projections 28 of the corner pieces 22.

The lower side pieces 12 are essentially a mirror image of the upper side pieces 11 except that the lower side pieces 12 have a channel 18 on the upper distal end thereof which receives the protrusion 111 of the upper side piece 11. Like the upper side pieces 11, the lower side pieces have a partition wall 15C forming a channel 16B, but this partition wall 15C and channel 16B are on the lower distal ends of the lower side pieces, rather than the upper distal end. Of course, hinges 4 are necessary between one of the lower side pieces 12 and one of the upper side pieces 11 for obvious reasons.

Still referring to FIG. 2, the lower corner pieces 22 will be explained in more detail. The lower corner pieces 22 basically act as joints to hold the lower end pieces 42 and the lower side pieces 12 together. Like the lower side pieces 12, the lower corner pieces 22 each have a channel 221 to receive the protrusion 211 (with similar cross-sectional area to the protrusion 111 on the upper side piece 11) of a corresponding upper corner piece 21. The lower corner pieces 22 also have a projection 28 at either lateral distal end thereof. These projections 28 fit tightly into the cavities 17 of the lower side and lower end pieces 12 and 42 so as to hold the lower half of the present invention together. Screw holes 14 on the end and side pieces match up with corresponding screw holes 281 on the projections so that after assembling all the pieces, the present invention can be secured with screws (not shown). When the upper pieces and one main panel are assembled, an upper half of the case is formed with a downwardly facing opening.

Figure 3:
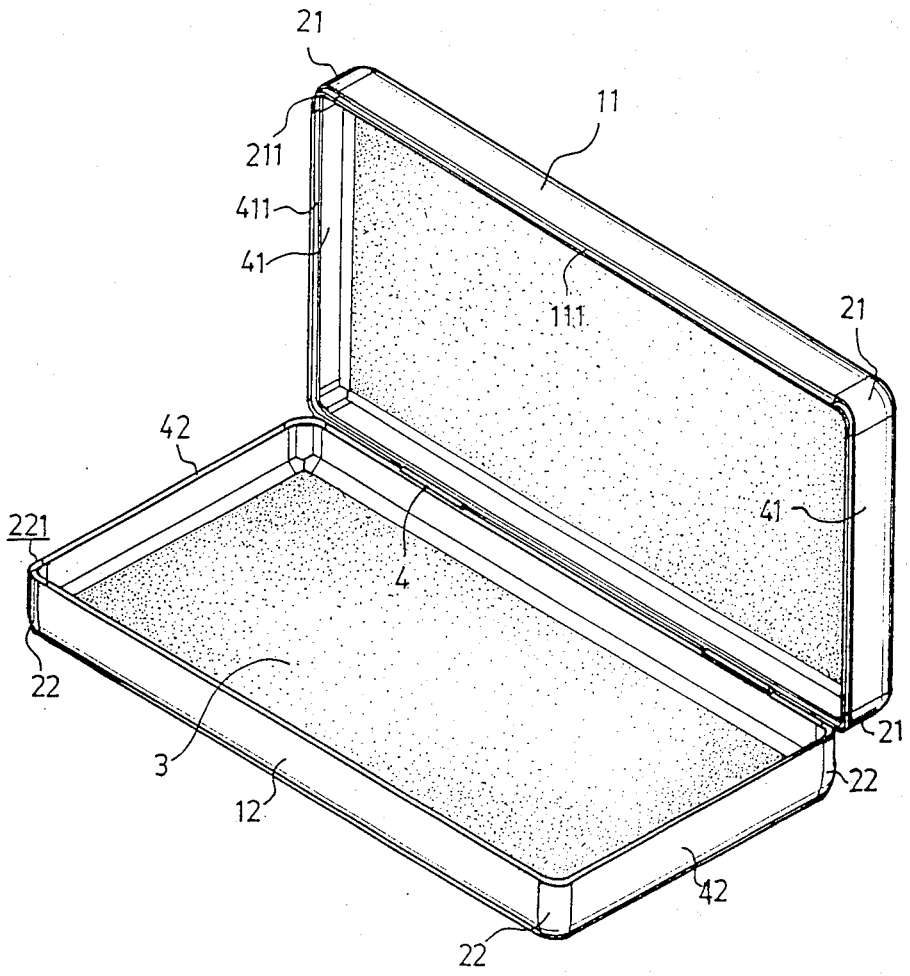
FIG. 3 is a perspective view of a carry-all case in accordance with the present invention, in open position.

Similarly, the upper corner pieces 21 have projections which fit into the cavities 17 of the upper side and upper end pieces 11 and 41 (see FIG. 3). The main difference between the upper portion of this invention and the lower portion of this invention is that all the upper pieces 11 and 41 and the upper corner pieces 21 have protrusions (111, 411, and 211, respectively) at the lower distal ends thereof which fit into corresponding channels 18, 421, and 221, respectively. Channel 18, incidently, is formed by another partition plate 15B, so that the lower pieces each have two partition plates 15A and 15B. When the lower pieces and a main panel are assembled the lower half of the case is formed having an upwardly facing opening which is adapted to mate with the aforementioned downwardly facing opening to form the case.

As various possible embodiments might be made of the above invention without departing from the scope of the invention, it is to be understood that all matter herein described or shown in the accompanying drawing is to be interpreted as illustrative and not in a limiting sense. Thus it will be appreciated that the drawings are exemplary of a preferred embodiment of the invention.

I claim:

1. A detachable case comprising:

(a) two main panels, each main panel being flat and rectangular in shape, and having a first protrusion on each of four edges thereof, respectively;

(b) four upper pieces, including two upper side pieces and two upper end pieces, each of said upper pieces being formed of two thin walls with an upper partition therebetween near an upper distal end, each upper piece comprising a channel set at an upper distal end of each of said upper pieces for receiving one of said first protrusions of one of said main panels, and a second protrusion set at a lower distal end of each of said upper pieces;

(c) for lower pieces, including two lower side pieces and two lower end pieces, each of said lower pieces being formed of two thin walls defining a wall cavity and having a middle partition at upper distal ends thereof and at lower partition at lower distal ends thereof, each of said lower pieces having a respective channel at a lower distal end thereof for receiving one of said first protrusions of one of said main panels, and each of said lower pieces also having a channel for receiving one of said second protrusions at the upper distal end thereof; and (d) eight corner pieces, including four upper corner pieces and four lower corner pieces, each of said corner pieces forming a substantially 90 degree angle between two distal ends thereof, and having two projections, one of said projections at each of said distal ends of said corner pieces for respectively engaging with the wall cavity of one said side pieces and one of said end pieces;

whereby the upper pieces and said one main panel, when the case is erected, form an upper case half having an upper case cavity with a downwardly facing opening, and whereby the lower pieces and the other main panel, when the case is erected, form a lower case half having a lower case cavity with an upwardly facing opening adapted with the downwardly facing opening to provide an enclosure with the case.

* * * * *